United States Patent [19]

McGee

[11] 4,453,391

[45] Jun. 12, 1984

[54] DEVICE FOR THE IN SITU REMOVAL OF DENTS IN COMPONENTS OF VEHICLES

[76] Inventor: Patrick J. McGee, 6 Kingsmere Gardens, Kilfennan, Londonderry, County Londonderry, Northern Ireland

[21] Appl. No.: 361,045

[22] Filed: Mar. 23, 1982

[30] Foreign Application Priority Data

Mar. 26, 1981 [GB] United Kingdom ..... 8109610

[51] Int. Cl.[3] ..... B21D 1/12; B21D 26/02

[52] U.S. Cl. ..... 72/54; 72/705

[58] Field of Search ..... 72/54, 57, 705; 254/93 HP; 29/421 R

[56] References Cited

U.S. PATENT DOCUMENTS

| | | | |
|---|---|---|---|
| 2,804,118 | 8/1957 | Bayerkohler | 72/705 |
| 3,026,541 | 3/1962 | Murat | 254/93 HP |
| 3,180,130 | 4/1965 | Avera | 72/465 |
| 3,982,731 | 9/1976 | Tezuka | 254/93 HP |
| 4,171,631 | 10/1979 | Butts | 72/705 |

FOREIGN PATENT DOCUMENTS 2272021 5/1975 France .

*Primary Examiner*—Lowell A. Larson

*Attorney, Agent, or Firm*—Murray and Whisenhunt

[57] ABSTRACT

A device for removing dents in vehicles comprises an air-impervious inflatable vessel which, in use, is accommodated in the vehicle cavity behind a dent. Air under pressure is introduced by suitable means to the vessel so that it inflates to fill the cavity and swell outwardly to restore the dented area substantially to its original form.

2 Claims, 7 Drawing Figures

DEVICE FOR THE IN SITU REMOVAL OF DENTS IN COMPONENTS OF VEHICLES

BACKGROUND OF THE INVENTION

This invention relates to the in situ removal of dents in components, such as body panels and fuel tanks of vehicles such as passenger cars, vans, commercial vehicles and motorbikes.

When components such as body panels of vehicles are damaged and restoration thereof to the original form is required, the nature of the damage determines the remedy, and panel beating is a skilled art.

OBJECTS OF THE INVENTION

It is an object of the invention to provide a device and a method for the in situ removal of dents in components of vehicles which avoids the need for more than a minimum of conventional mechanical and/or hydraulic devices and conventional panel-beating techniques.

It is a further object of the invention to provide such a device and a method which allows rapid removal of dents with a considerable saving of time compared with the prior art.

It is a still further object of the invention to provide a set of devices for the in situ removal of dents which is versatile and can be used for a large variety of such dents.

SUMMARY OF THE INVENTION

In accordance with the present invention, I provide a device for use in the in situ removal of dents in components of vehicles, comprising closed air-impervious inflatable vessel shaped and dimensioned for accommodation in the vehicle cavity behind a dent and means for introducing air under pressure into said vessel, whereby, on inflation with air when so accommodated, the vessel fills the cavity behind the dented area and swells outwardly to restore the dented area substantially to its original form.

Furthermore I provide a method for the in situ removal of dents in components of vehicles, comprising positioning in the cavity behind the dented area a closed air-impervious inflatable vessel and introducing air under pressure into said vessel so that the vessel fills the cavity behind the dented area and swells outwardly to restore the dented area substantially to its original form. After use the vessel can be removed for reuse simply by releasing the pressure.

DESCRIPTION OF THE PREFERRED EMBODIMENTS

Figure 1:
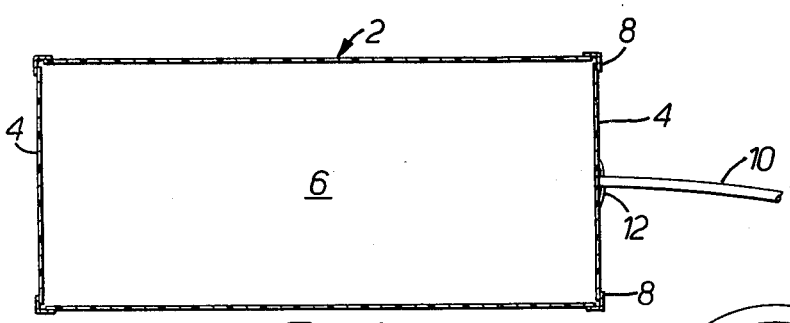
FIG. 1 is a longitudinal cross section through one form of device in accordance with the invention in its uninflated form.

The vessel may be of natural or synthetic rubber or, more preferably, of the more abrasion resistant polyurethane proofed nylon of uniform thickness throughout (such as 1/16" (0.16 cm) thick for polyurethane proofed nylon) and is shaped and dimensioned to be accommodated in the cavity between the dented area of the body panel and the support structure therebehind. However it may be convenient for the vessel to have surface areas of greater and lesser distention on inflation, an area of greater potential distention being positioned in use adjacent the dent. One convenient shape is substantially cylindrical when inflated and comprises a pair of circular end panels joined by a continuous side wall panel. A further preferred shape in uninflated form comprises a pair of overlying flat panels sealed at the edges to form a closed bag. Such a bag, suitably rectangular, can be of any suitable size and can conveniently be folded if desired to alter its size. An inflation tube through which the vessel can be inflated, and through which compressed air can be released from the vessel, is provided at any appropriate point in the wall of the vessel. If necessary some form of regulator can be applied to the valve used with the inflation tube to prevent over inflation and possible bursting of the vessel and damage to the panel being treated.

Any suitable working pressure can be used to remove the dents, a pressure of 2 to 10 lbs/sq.in (0.14 to 0.71 kg/sq.cm) being suitable for most purposes. Of course some dents will require lower pressures than others and much also depends on the material, e.g. metal or fibreglass, being treated.

The vessel may of course be of other shapes. Appropriately a number of differently shaped vessels would be available, that of the shape most convenient for removal of a dent or dents being chosed on any occasion. Preferably the vessel chosen will be of a size that more than covers the dented area.

In use a non-inflated vessel as described and of a shape appropriate to the damaged area of a body panel of a vehicle is inserted through an access opening into the space between the damaged area and the support structure. The vessel is inflated and accommodates itself to the surface configuration of the damaged area. Additional pressurized air causes the vessel to distend and flatten out the dent or dents from the inside, thereby to restore the body panel to its original form.

Clearly, care has to be taken with dents having sharp fold lines and/or punctures to ensure that any edges of the body panel do not come into direct contact with the device thereby to prevent possible rupture of the skin of the vessel. However, should rupturing occur, it is a simple matter to apply a repair patch to the material of the vessel.

The above described device is advantageous in that it removes or assists in removing dents with greater accuracy and causes less panel stretching than with methods employed heretofore. It can also obviate the necessity in a majority of occasions for using conventional mechanical and/or hydraulic wedges. Furthermore there is a great reduction in the time needed to repair the dent. Thus even though some panel beating may be required to finish the job, it is estimated that a job conventionally taking about 2 hours may be reduced to 15 or 20 minutes.

Figure 2:
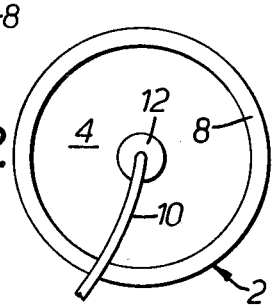
FIG. 2 is an end view of the device of FIG. 1.
Figure 3:
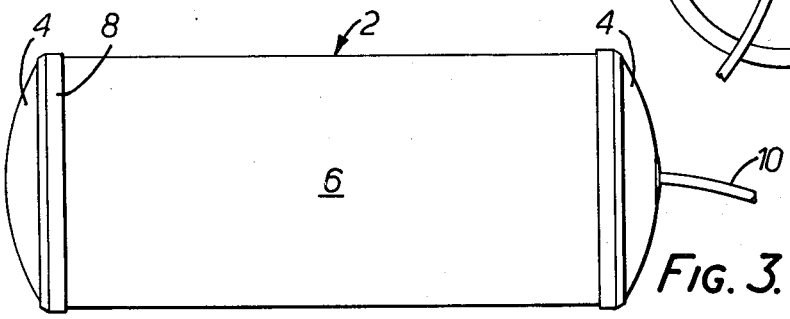
FIG. 3 is a side view of the device of FIG. 1 when inflated.

Referring firstly to FIGS. 1 to 3, which illustrate one non-limiting embodiment of the invention, the device shown comprises a vessel 2 suitably of polyurethane proofed nylon of 1/16"(0.16 cm) thickness. Vessel 2 has two circular end wall panels 4 joined by a continuous side wall panel 6 in the form of a cylinder formed by curving a flat sheet and welding or otherwise suitably connecting the longitudinal abutting edges of the sheet. The panels 4 and 6 are suitably joined to make a closed container, for example by the use of welded sealing strips 8. An inflation tube 10 is suitably welded via a flange 17 to one end panel 4, but could of course be positioned elsewhere on the device. When uninflated the vessel 2 will lie in a flattened, crumpled condition.

When the device of FIGS. 1 and 2 is inflated via tube 10 with pressurised air, it assumes a configuration as shown in FIG. 3 with the end panels 4 becoming somewhat convex.

In use the vessel 6, in its uninflated condition, is placed behind a body panel of a vehicle having a dent to be repaired. The vessel 2 will normally be positioned between the body panel and the inner support structure of the vehicle. However if there is no such inner support structure adjacent the dent to be mended, any suitable backing member, such as a suitably sized piece of wood, can be wedged behind the vessel. The vessel 2 can be positioned with an end face 4 or the panel 6 against the dent, dependent on the size of the dent and the shape of the space available behind the dent. The vessel 2 should be sized to more than cover the dented area. Air under pressure is then introduced through tube 10 into the vessel 2 so that it expands to the shape shown in FIG. 3 and exerts pressure on the dent while conforming to the contour of the dent and returning the dent towards its original shape. When the desired shape is attained, the pressure is released and vessel 2 collapses and can be removed by subsequent re-use. Further finishing by panel beating may be carried out if necessary but the time for the repair will in any case have been greatly reduced. Any further panel beating may be carried out with the vessel still in place or after its removal whichever is more convenient.

Figure 4:
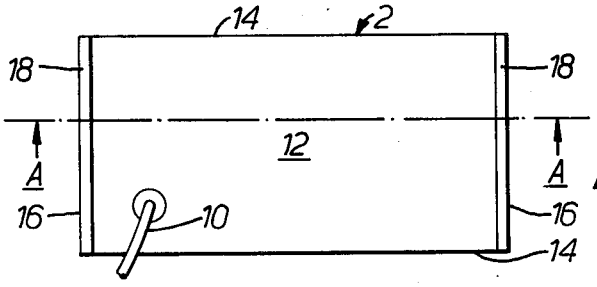
FIG. 4 is a plan view of an alternative form of device in accordance with the invention in its uninflated form.
Figure 5:
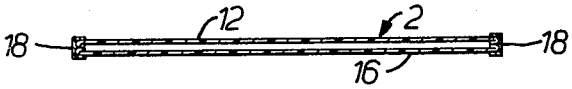
FIG. 5 is a section on line A—A of FIG. 4.
Figure 6:
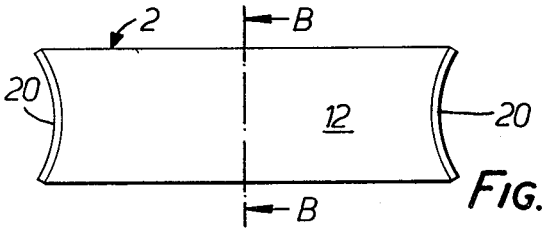
FIG. 6 is a side view of the device of FIG. 4 when inflated.
Figure 7:
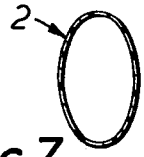
FIG. 7 is a section on the line B—B of FIG. 6.

The device shown in FIGS. 4 to 7, which shows a further non-limiting embodiment of the invention, comprises a vessel 2 of the same material as that of FIGS. 1 to 3, which in collapsed form as shown in FIGS. 4 and 5 comprises two rectangular overlying panels 12 secured by any suitable means such as welding along one pair of opposite edges 14. The other pair of opposite edges 16 may be secured in the same way or may have sealing or reinforcing strips 18 secured thereover, suitably by welding as shown in FIG. 5 so that a closed vessel is formed. One panel 12 has an inflation tube 10 affixed thereto. On inflation, vessel 2 inflates to the conformation shown in FIGS. 6 and 7 with a midsection of oval cross section, best seen in FIG. 7 and concave ends 20 as shown in FIG. 6. In use the vessel 2 will be introduced behind a dent as described for FIGS. 1 to 3 with a panel 12 overlying the dent. If the vessel 2 is too big, because of its lie-flat conformation in the uninflated state, it can be folded so that the operative portion of the vessel becomes smaller. The vessel shown in FIGS. 4 to 7 is thus versatile and easy to store.

The devices according to the invention can clearly be formed in a variety of sizes and shapes to suit the size and variety of possible dents to be mended. As well as the two types of vessel shown in FIGS. 1 to 3 and FIGS. 4 to 7, it may well be convenient to provide vessels which inflate to a substantially square or cuboid shape. Examples of vessels of the type shown in FIGS. 1 to 3 have end panels of diameter 3" (7.62 cm), 9" (22.86 cm) or 12" (30.48 cm) with lengths respectively of 6" (15.24 cm), 24" (60.96 cm) and 6" (15.24 cm). Examples of vessels of the type shown in FIGS. 4 to 7 are of 30"×18" (76.2×45.72 cm), 38"×18" (96.52×45.72 cm), 34"×22" (86.36×55.88 cm), 38"×22" (96.52×55.88 cm) and 15"×24" (38.1×60.96 cm). Examples of vessles which inflate to a substantially cuboid shape may be of dimensions 12"×12"×6" (30.48×30.48×15.24 cm) or 6"×6"×4" (15.24×15.24×10.66 cm).

I claim:

1. A process for the in situ removal of dents in components of vehicles comprising, positioning a closed air-impervious inflatable vessel in a cavity between a dented area and a support structure provided by the inner support structure of the vehicle and/or a separately provided backing member, said inflatable vessel being of a size to more than cover the dented area and to accomodate itself to the surface configuration of the dented area upon partial inflation;

introducing air under pressure into said vessel, whereby the vessel fills the cavity behind the dented area and accomodates itself to the surface configuration of the damaged area; and introducing additional air under pressure into said vessel, whereby the vessel swells outwardly to restore the dented area substantially to its original form.

2. A process according to claim 1, wherein the dented area is in a body panel of a vehicle.

* * * * *